US010322489B2

(12) United States Patent
Mizutani et al.

(10) Patent No.: US 10,322,489 B2
(45) Date of Patent: Jun. 18, 2019

(54) CAM GRINDING MACHINE AND CAM GRINDING METHOD

(71) Applicant: JTEKT CORPORATION, Osaka-shi (JP)

(72) Inventors: Yoshihiro Mizutani, Kitanagoya (JP); Satoshi Abeta, Chita (JP); Masaharu Inoue, Obu (JP)

(73) Assignee: JTEKT CORPORATION, Osaka-shi (JP)

( * ) Notice: Subject to any disclaimer, the term of this patent is extended or adjusted under 35 U.S.C. 154(b) by 176 days.

(21) Appl. No.: 15/350,680

(22) Filed: Nov. 14, 2016

(65) Prior Publication Data

US 2017/0144264 A1 May 25, 2017

(30) Foreign Application Priority Data

Nov. 20, 2015 (JP) ..... 2015-227203

(51) Int. Cl.
*B24B 19/12* (2006.01)
*B24B 17/02* (2006.01)

(52) U.S. Cl.
CPC ..... *B24B 19/12* (2013.01); *B24B 17/025* (2013.01)

(58) Field of Classification Search
CPC ..... B24B 19/125; B24B 19/12; B24B 51/00; B24B 49/14
USPC ..... 451/5, 8, 9, 10, 62, 58
See application file for complete search history.

(56) References Cited

U.S. PATENT DOCUMENTS 4,528,781 A * 7/1985 Koide ..... B24B 19/125 451/62
4,621,463 A * 11/1986 Komatsu ..... B24B 19/125 451/58
6,811,465 B1 * 11/2004 Mavro-Michaelis ..... B24B 1/00 451/11

FOREIGN PATENT DOCUMENTS

DE 103 33 916 B4 10/2010
JP 4-13560 1/1992

* cited by examiner

*Primary Examiner* — Robert A Rose
(74) *Attorney, Agent, or Firm* — Oblon, McClelland, Maier & Neustadt, L.L.P.

(57) ABSTRACT

A cam grinding method includes: a common base circle portion setting step of obtaining an angular range of a common surface based on first cam lift data of a first cam and second cam lift data of a second cam; a first cam grinding step of grinding the first cam; a second cam grinding step of grinding the second cam; and a common base circle portion traverse grinding step of, after the second cam grinding step, moving a grinding wheel in a traverse direction to perform spark-out of an unground part remaining at the boundary between the first and second cams.

9 Claims, 18 Drawing Sheets

CAM GRINDING MACHINE AND CAM GRINDING METHOD

INCORPORATION BY REFERENCE

The disclosure of Japanese Patent Application No. 2015-227203 filed on Nov. 20, 2015 including the specification, drawings and abstract, is incorporated herein by reference in its entirety.

BACKGROUND OF THE INVENTION

1. Field of the Invention

The present invention relates to cam grinding machines and cam grinding methods. More particularly, the present invention relates to a grinding machine and a grinding method for a composite cam in which two cams having different cam lifts and different phase angles are disposed to adjoin each other in the axial direction.

2. Description of the Related Art

Intake and exhaust processes to and from a cylinder of an internal combustion engine are performed by a valve opening operation. The valve opening operation is performed by operation of a rotary cam.

In order to improve output of the internal combustion engine etc., different valve opening control processes are used for the valve opening operation depending on whether the engine speed is high or low.

In one of such control methods, a first cam for low speeds and a second cam for high speeds are provided as a cam that operates a valve, and valve opening control is performed by selecting the first cam and the second cam as appropriate according to the engine speed. In this case, selective switching between the first cam and the second cam is carried out as a tappet of the valve moves relative to the first cam and the second cam in the axial direction while in contact with the first cam and the second cam.

FIGS. 21 to 23 are schematic views showing the positional relationship between a first cam 112 for low speeds and a second cam 114 for high speeds. As can also be seen from these figures, the first cam 112 for low speeds typically has low maximum lift height, and the maximum lift height of the second cam 114 for high speeds is typically greater than that of the first cam 112. The phase angles of the first and second cams 112, 114 are such that the phase of the second cam 114 for high speeds is ahead of that of the first cam 112 for low speeds with respect to their rotational direction (direction shown by arrow in FIG. 21), namely such that the valve opening operation is performed earlier by the second cam 114 than by the first cam 112. As shown in FIG. 21, the first cam 112 for low speeds and the second cam 114 for high speeds are positioned such that the cam profile in the lift height direction of the second cam 114 and the cam profile in the lift height direction of the first cam 112 are shifted from each other in the angular direction.

As shown in FIGS. 22 and 23, the first cam 112 for low speeds and the second cam 114 for high speeds are disposed so as to adjoin each other in the axial direction. Namely, the first and second cams 112, 114 are provided as a composite cam 110. In this case, both the first cam 112 for low speeds and the second cam 114 for high speeds are formed such that a base circle portion other than the cam profile that changes in the lift height direction according to the angle has a fixed radius r from the camshaft center. A certain angle range in which the base circle portions of the first and second cams 112, 114 overlap each other is a common base circle portion C. In the range of this common base circle portion C, the tappet moves relative to the first and second cams 112, 114 while in contact therewith to switch between the first and second cams 112, 114 as described above.

Grinding of the composite cam 110 comprised of the first cam 112 for low speeds and the second cam 114 for high speeds is usually performed with a cam grinding machine using a grinding wheel T (see FIGS. 22 and 23). Grinding of the composite cam 110 is implemented by performing plunge grinding of one of the first and second cams 112, 114 and then performing plunge grinding of the other.

For example, FIGS. 22 and 23 show the case where grinding of the first cam 112 for low speeds is first performed and then grinding of the second cam 114 for high speeds is performed. In this case, grinding of the first cam 112 is performed with the grinding wheel T based on preset cam lift data of the first cam 112 for low speeds. Thereafter, the grinding wheel T is moved to the position corresponding to the second cam 114 for high speeds, and grinding of the second cam 114 is performed with the grinding wheel T based on preset cam lift data of the second cam 114 for high speeds. Grinding of the composite cam 110 is thus performed with the cam grinding machine. See, e.g., German Patent No. DE 10333916 B4 and Japanese Patent Application Publication No. H04-13560 (JP H04-13560 A).

As shown in FIG. 23, in the above grinding of the composite cam 110 with the cam grinding machine using the grinding wheel T, the composite cam 110 is not completely ground. Namely, the composite cam 110 has an unground part F at the boundary between the first and second cams 112, 114 in the range of the common base circle portion C. In FIGS. 22 and 23, the unground part F is shown exaggerated in order to facilitate understanding. Specifically, the size of the unground part F is on the order of several micrometers.

If the composite cam 110 has the unground part F at the boundary between the first and second cams 112, 114 in the range of the common base circle portion C, the tappet gets over the unground part F when relatively moving between the first and second cams 112, 114. The operation of moving the tappet relative to the first and second cams 112, 114 is therefore not smoothly performed, which affects valve opening control. The grinding wheel T therefore need be trued frequently.

The problem that the composite cam 110 has the unground part F will be described specifically. As shown in FIGS. 22 and 23, the grinding wheel T has a greater axial width than the first cam 112 for low speeds and the second cam 114 for high speeds. The grinding wheel T becomes blunt at both ends Ta, Tb of its grinding surface as a workpiece, or a cam, is ground with the grinding wheel T. Namely, the grinding wheel T is worn faster at both ends Ta, Tb of its grinding surface than in the middle thereof, causing blunting of the ends Ta, Tb of the grinding wheel T.

As shown in FIG. 22, in the case of performing plunge grinding of the first cam 112 for low speeds, the grinding wheel T is positioned such that its right end Ta is aligned with the boundary between the first and second cams 112, 114. The left end Tb of the grinding wheel T therefore projects beyond the left side of the first cam 112. Blunting of the left end Tb of the grinding wheel T thus does not affect grinding of the first cam 112. However, blunting of the right end Ta of the grinding wheel T affects grinding of the first cam 112 side of the boundary between the first and second cams 112, 114, leaving an unground part F. The black part in FIG. 22 shows the unground part F. In FIGS. 22 and 23, grinding allowances of the first and second cams 112, 114, which are shown by phantom lines, are also shown exaggerated in order to facilitate understanding.

As shown in FIG. 23, after grinding of the first cam 112 is finished, the grinding wheel T is relatively moved to the position of the second cam 114 to perform plunge grinding of the second cam 114. In this plunge grinding, the grinding wheel T is positioned such that its left end Tb is aligned with the boundary between the first and second cams 112, 114. The right end Ta of the grinding wheel T therefore projects beyond the right side of the second cam 114. Blunting of the right end Ta of the grinding wheel T thus does not affect grinding of the second cam 114. However, blunting of the left end Tb of the grinding wheel T affects grinding of the second cam 114 side of the boundary between the first and second cams 112, 114, leaving an unground part F. This unground part F together with the unground part F of the first cam 112 in FIG. 22, both shown black in FIG. 23, remains at the boundary between the first and second cams 112, 114.

SUMMARY OF THE INVENTION

It is one object of the present invention to provide a cam grinding machine that can remove an unground part that is produced at the boundary in a common base circle portion between a first cam and a second cam of a composite cam which have different lift heights.

A cam grinding machine according to one aspect of the present invention grinds a composite cam.

The composite cam includes: a first cam that has a first base circle portion having a first radius and a fixed lift height from a central axis to its outer peripheral surface, and a first cam portion having a varying lift height from the central axis to its outer peripheral surface; and a second cam that has a second base circle portion having the first radius and a fixed lift height from the central axis to its outer peripheral surface, and a second cam portion having a varying lift height from the central axis to its outer peripheral surface. The first cam and the second cam are coaxially disposed so as to adjoin each other in an axial direction. The first cam and the second cam have different shapes from each other, the shape of the first cam corresponding to first cam lift data and the shape of the second cam corresponding to second cam lift data. At least a part of the outer peripheral surface of the first base circle portion and at least a part of the outer peripheral surface of the second base circle portion are flush with each other to form a common base circle portion.

The cam grinding machine includes: a base unit that serves as a base; a spindle device placed over the base unit and including a workpiece rotating device that supports the composite cam about the central axis so that the composite cam is rotatable; a grinding wheel device placed over the base unit and including a rotary grinding wheel; a traverse moving device that can reciprocate the grinding wheel relative to the composite cam in the axial direction; a plunge moving device that can move the grinding wheel relative to the composite cam in a direction crossing the axial direction; and a control device that controls the workpiece rotating device, the traverse moving device, and the plunge moving device.

The control device includes: a common base circle portion setting unit that obtains an angular range of the common base circle portion formed by at least the part of the outer peripheral surface of the first base circle portion and at least the part of the outer peripheral surface of the second base circle portion being flush with each other, based on the first cam lift data in which a lift with respect to a rotation angle of the first cam is set and the second cam lift data in which a lift with respect to a rotation angle of the second cam is set; a first cam grinding unit that controls the plunge moving device and the traverse moving device to move the grinding wheel to a position facing the outer peripheral surface of the first cam, and controls the workpiece rotating device and the plunge moving device to grind the first cam; a second cam grinding unit that, after the grinding of the first cam, controls the plunge moving device and the traverse moving device to move the grinding wheel to a position facing the outer peripheral surface of the second cam, and controls the workpiece rotating device and the plunge moving device to grind the second cam; and a common base circle portion traverse grinding unit that, after the grinding of the second cam, controls the traverse moving device to move the grinding wheel from a position of the second cam to a position beyond a boundary between the first and second cams in a traverse direction, and controls the workpiece rotating device to rotate the composite cam within the angular range of the common base circle portion with respect to the grinding wheel to perform traverse grinding of the common base circle portion.

According to the cam grinding machine of the above aspect, if the grinding of the first and second cams of the composite cam with the grinding wheel is performed by using the first cam grinding unit and the second cam grinding unit, an unground part remains at the boundary between the cams in the common base circle portion. This unground part is removed as follows.

First, the angular range of the common base circle portion of the first and second cams where the unground part remains is obtained by the common base circle portion setting unit of the control unit. This angular range is obtained based on the first cam lift data of the first cam and the second cam lift data of the second cam.

After the grinding of the first cam and the second cam is finished, the grinding wheel is moved in the traverse direction from the position of the second cam ground by using the second cam grinding unit to a position on the outer peripheral surface of the boundary between the first and second cams in the common base circle portion where the unground part remains. Traverse grinding of this angular range of the common base circle portion is performed to remove the unground part at the boundary.

After the grinding of the second cam using the second cam grinding unit is finished, the grinding wheel is moved as it is in the traverse direction without being withdrawn or advanced. Accordingly, the unground part can be reliably removed. In the case where the grinding wheel is withdrawn, moved in the traverse direction to the position of the boundary, and advanced to perform plunge grinding after the grinding of the second cam using the second cam grinding unit is finished, there may be a deviation in the advanced position of the grinding wheel, and the unground part may not be completely removed.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Embodiments of the present invention will be described below with reference to the accompanying drawings.

Figure 1:
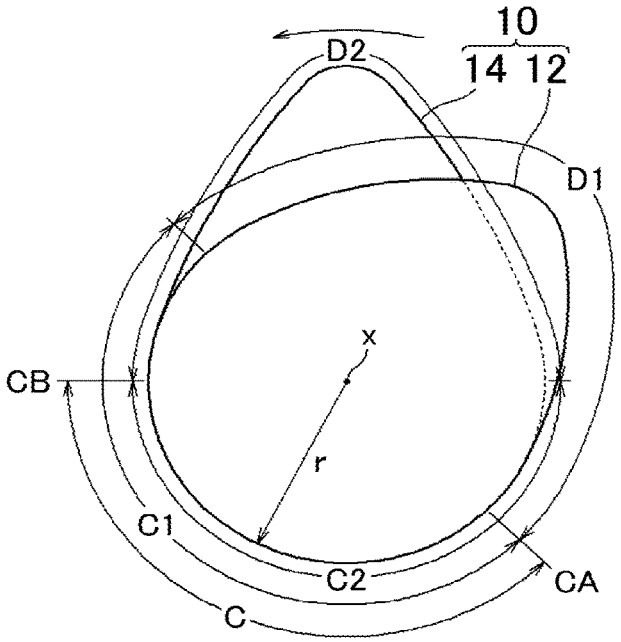
FIG. 1 is a schematic view of a composite cam of an embodiment of the present invention as viewed in the direction of a cam axis.
Figure 2:
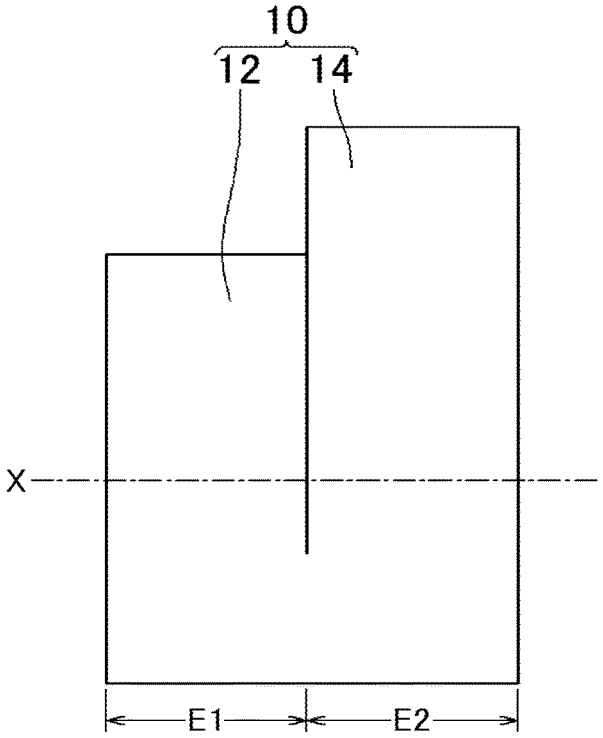
FIG. 2 is a side view of a first cam and a second cam of the composite cam as viewed in a direction perpendicular to the cam axis.

First, a composite cam 10 according to an embodiment will be described. FIG. 1 is a schematic view of the composite cam 10 as viewed in the direction of a cam axis x. FIG. 2 is a side view showing the maximum lift height positions of a first cam 12 and a second cam 14 of the composite cam 10 as viewed in a direction perpendicular to the cam axis x.

As shown in FIG. 2, the composite cam 10 of the present embodiment is formed by the first cam 12 and the second cam 14 which are disposed so as to adjoin each other in the axial direction. In the present embodiment, the first cam 12 serves as a cam for low speeds and the second cam 14 serves as a cam for high speeds. The maximum lift height of the first cam 12 for low speeds is lower than that of the second cam 14 for high speeds. As shown in FIG. 2, the first cam 12 for low speeds and the second cam 14 for high speeds are formed with the same width in the axial direction x. That is, the width E1 of the first cam 12 is the same as the width E2 of the second cam 14.

As shown in FIG. 1, the first cam 12 for low speeds and the second cam 14 for high speeds have different phase angles. The phase of the second cam 14 for high speeds is ahead of that of the first cam 12 for low speeds with respect to the rotational direction (direction shown by arrow in FIG. 1) of an internal combustion engine. A valve opening operation for the internal combustion engine is therefore performed earlier by the second cam 14 than by the first cam 12. In the present embodiment, the first cam 12 for low speeds and the second cam 14 for high speeds are positioned such that the cam profile in the lift height direction of the second cam 14 and the cam profile in the lift height direction of the first cam 12 are shifted from each other in the angular direction and also protrude from each other as viewed in the direction of the cam axis. The maximum cam height position of one cam may be out of phase with that of the other cam even if their cam profiles do not protrude from each other and the other cam profile is located within one cam profile.

As shown in FIG. 1, each of the contour of the first cam 12 and the contour of the second cam 14 consists of a base circle portion having a fixed first radius r from the central axis x of the cam and a cam height varying profile portion other than the base circle portion. In FIG. 1, C1 represents a first base circle portion of the first cam 12, and D1 represents a cam height varying profile portion of the first cam 12. Similarly, C2 represents a second base circle portion of the second cam 14, and D2 represents a cam height varying profile portion of the second cam 14. Since the first cam 12 and the second cam 14 have different cam heights and different phase angles, the range of the first base circle portion C1 is different from that of the second base circle portion C2. In FIG. 1, the common base circle portion C shows the surface portions of the first and second cams 12, 14 which are flush with each other, namely the surface portions of the first and second cams 12, 14 in which the first base circle portion C1 of the first cam 12 and the second base circle portion C2 of the second cam 14 overlap each other.

Figure 3:
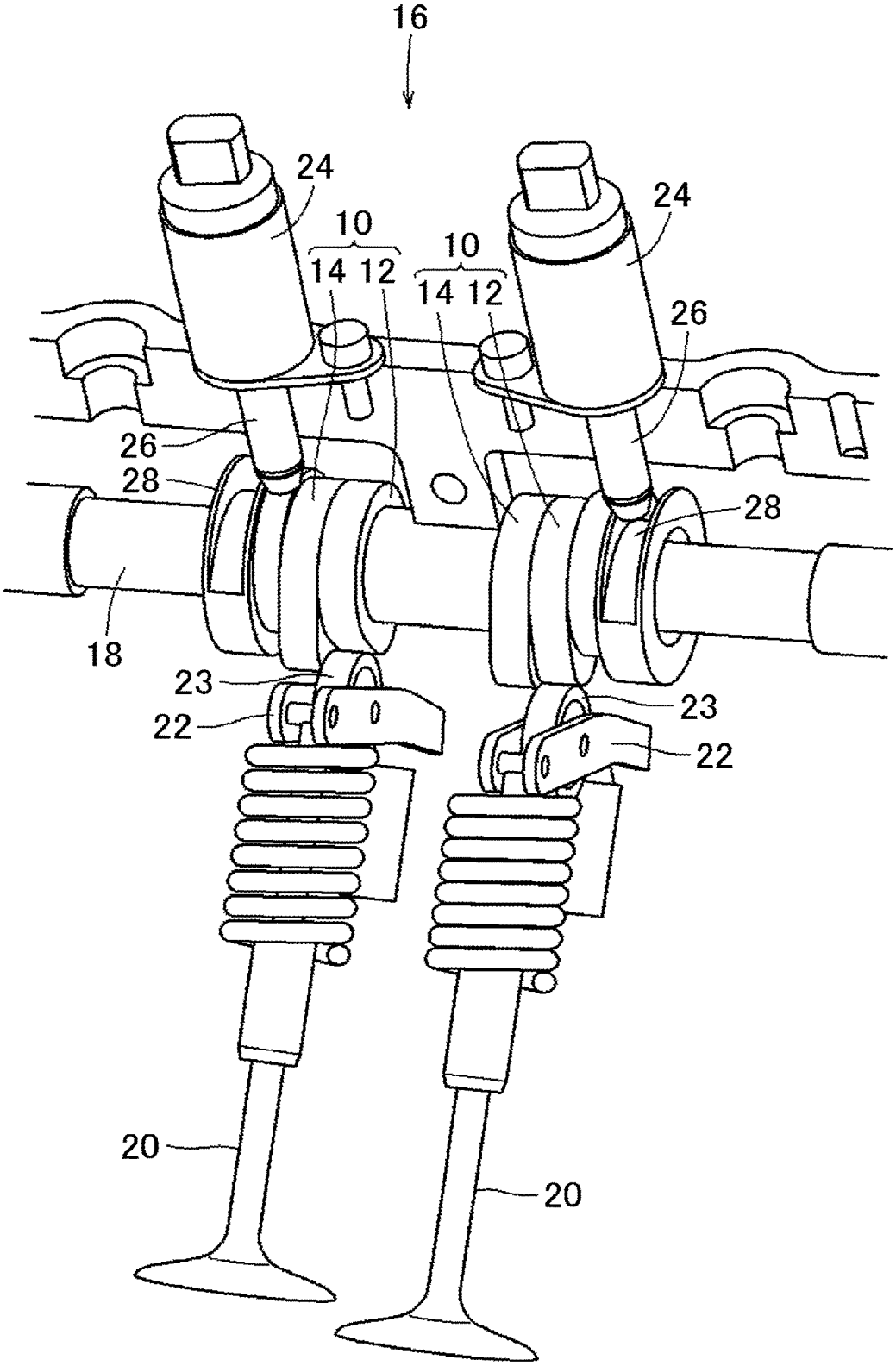
FIG. 3 is a perspective view of an embodiment showing an example of a cam control mechanism that selectively controls composite cams 14.

FIG. 3 shows an embodiment illustrating an example of a cam control mechanism 16 that selectively controls the first cam 12 and the second cam 14 of the composite cam 10 mounted on a camshaft 18. The first cam 12 and the second cam 14 are disposed on the camshaft 18. The first cam 12 and the second cam 14 are provided for each valve 20 and together form the composite cam 10. In the present embodiment, two of the composite cams 10 are mounted on the camshaft 18 so that the composite cams 10 can rotate integrally with respect to the camshaft 18 and can move in the axial direction.

Each valve 20 is moved up and down by a swinging motion of a corresponding one of tappets 22. The tappet 22 selectively contacts the first cam 12 or the second cam 14 and is thus swung by the cam 12, 14. Specifically, the tappet 22 is provided with a tappet roller 23, and the tappet 22 selectively contacts the first cam 12 or the second cam 14 by contact between the tappet roller 23 and the cam 12, 14. This selective contact between the tappet 22 and the cam 12, 14 is achieved by engagement between a pin 26 of an actuator 24 such as an electromagnetic solenoid and a helically grooved element 28 provided integrally with the composite cam 10 on a side of the composite cam 10. The helically grooved element 28 has an axial helical groove in its outer peripheral surface. The pin 26 of each actuator 24 engages with the helical groove of each helically grooved element 28, whereby the two composite cams 10 are moved in the axial direction by rotation of the camshaft 18 and the composite cams 10. The helical grooves of the helically grooved elements 28 disposed on the right and left sides are formed in the same direction. For example, the composite cams 10 move to the right when the pin 26 engages with the helical groove of one helically grooved element 28. The composite cams 10 move to the left when the pin 26 engages with the helical groove of the other helically grooved element 28. The position of the cam that contacts the tappet 22 is switched in this manner. The switching operation using the actuator 24 is performed when the tappet 22 is in contact with the common base circle portion C of the first cam 12 or the second cam 14.

Figure 4:
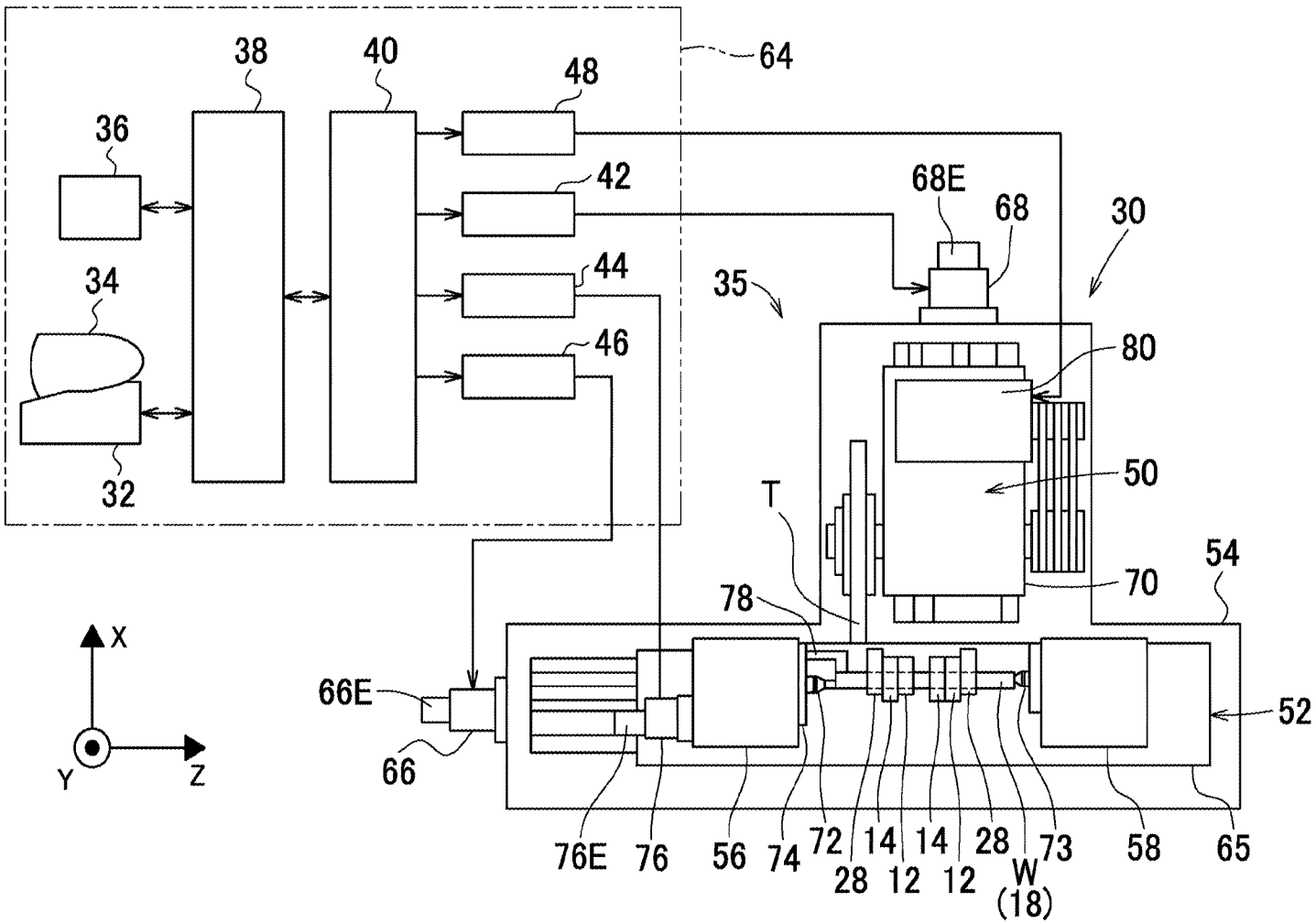
FIG. 4 is a plan view of a cam grinding machine.
Figure 5:
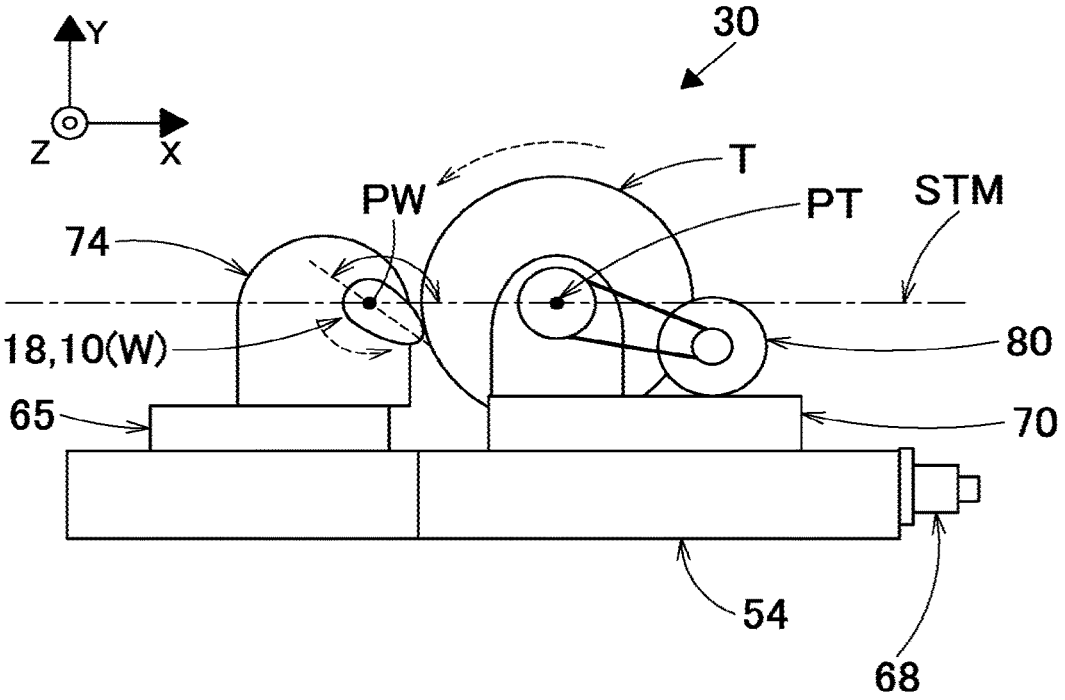
FIG. 5 is a right side view of the cam grinding machine.

A cam grinding machine 30 will be described below with reference to FIGS. 4 and 5. FIG. 4 is a plan view and FIG. 5 is a right side view. A tailstock device 58 in FIG. 4 is not shown in FIG. 5. The X-, Y-, and Z-axes in the figures are perpendicular to each other. The Y-axis direction is the upward vertical direction and the X- and the Z-axis directions are horizontal directions perpendicular to each other.

The cam grinding machine 30 of the present embodiment rotates and supports the camshaft 18, or a workpiece W, having the composite cams 10 and grinds the camshaft 18 with a cylindrical grinding wheel T. As shown in FIG. 4, the cam grinding machine 30 includes an input device 32 such as a keyboard, a display device 34 such as a monitor, a data read device 36 such as a tape reader, an automatic programming device 38, a numerical control device 40, drive units 42, 44, 46, 48, a grinding wheel device 50, and a workpiece support device 52.

The data read device 36 reads various data according to an operation that is performed by the operator using the input device 32 and the display device 34. In this case, the data read device 36 reads cam lift data that specifies the shape of the composite cam 10 to be ground and the radius of the grinding wheel T. In the present embodiment, the data read device 36 reads two pieces of cam lift data, namely cam lift data of the cams 12, 14 having different phase angles and different lift heights shown in FIG. 1. Namely, the data read device 36 reads first cam lift data showing the shape of the first cam 12, second cam lift data showing the shape of the second cam 14, the angle from a reference phase to the phase corresponding to the maximum lift of the first cam 12, and the angle from a reference phase to the phase corresponding to the maximum lift of the second cam 14. The reference phase of the first cam 12 is the same as that of the second cam 14.

The operator inputs the following data to the input device 32 while looking at the display device 34.

(a) the width E1 of the first cam 12

(b) the width E2 of the second cam 14

(c) the width G and diameter H of the grinding wheel T (d) the rotational speed m1 of the grinding wheel T, the rotational speed n1 of a spindle 74, and the infeed J of the grinding wheel T for air grinding (e) the rotational speed m2 of the grinding wheel T, the rotational speed n2 of the spindle 74, and the infeed K of the grinding wheel T for rough grinding (f) the rotational speed m3 of the grinding wheel T, the rotational speed n3 of the spindle 74, and the infeed M of the grinding wheel T for fine grinding (g) the rotational speed m4 of the grinding wheel T, the rotational speed n4 of the spindle 74, and the amount of rotation of the spindle 74 for spark-out (h) the rotational speed m5 of the grinding wheel T, the rotational speed n5 of the spindle 74, and the amount of rotation of the spindle 74 at the time of removing an unground part The data (d) to (g) is input for each of a first cam grinding step and a second cam grinding step, and a program for the first cam grinding step and a program for the second cam grinding step are automatically created by the automatic programming device 38.

The cam grinding machine 30 includes a base unit 54 serving as a base on which various devices are placed. The cam grinding machine 30 has a worktable 65 and a wheel head 70 on the base unit 54. The worktable 65 can be reciprocated in the Z-axis direction by a worktable drive device 66. The wheel head 70 can be reciprocated in the X-axis direction by a wheel head drive device 68. The worktable drive device 66 of the present embodiment corresponds to the traverse moving device of the present invention, and the wheel head drive device 68 corresponds to the plunge moving device.

The cam grinding machine 30 has a spindle device 56 and the tailstock device 58 on the worktable 65. The spindle device 56 includes the spindle 74. The spindle 74 rotates about a spindle rotation axis being parallel to the Z-axis and passing through the center of a center 72. The tailstock device 58 includes a center 73 disposed on the spindle rotation axis. The spindle 74 can be rotated by a spindle drive device 76. The spindle drive device 76 corresponds to the workpiece rotating device of the present invention. The centers 72, 73 hold the camshaft 18 having the composite cams 10, or the workpiece W, therebetween. The spindle 74 is provided with a positioning pin 78 that causes the camshaft 18, or the workpiece W, and the spindle 74 to rotate in phase with each other. The camshaft 18, or the workpiece W, has a fitting portion (not shown) in which the positioning pin 78 is fitted. The camshaft 18 is thus positioned such that the positioning pin 78 is fitted in the fitting portion, and is held between the centers 72, 73.

The wheel head 70 has the grinding wheel T placed thereon. The grinding wheel T is rotated by a grinding wheel drive device 80 such as a motor. In the present embodiment, the wheel head 70, the grinding wheel T, and the grinding wheel drive device 80 form the grinding wheel device 50 of the present invention.

The numerical control device 40 controls various devices by outputting control signals to the drive units 42, 44, 46, 48 to drivingly control the various drive devices 68, 76, 66, 80. In the present embodiment, the numerical control device 40 controls the position in the X-axis direction of the wheel head 70, or the position to which the grinding wheel T is advanced or withdrawn, by outputting a control signal to the drive unit 42 to drivingly control the wheel head drive device 68. The numerical control device 40 also controls the rotation angle of the spindle 74 by outputting a control signal to the drive unit 44 to drivingly control the spindle drive device 76. The numerical control device 40 also controls the position in the Z-axis direction of the worktable 65 by outputting a control signal to the drive unit 46 to drivingly control the worktable drive device 66. The numerical control device 40 also controls the rotational speed of the grinding wheel T by outputting a control signal to the drive unit 48 to drivingly control the grinding wheel drive device 80.

The drive unit 44 obtains an actual rotation angle of the spindle 74 from a detection signal of an encoder 76E of the spindle drive device 76 to perform feedback control. The drive unit 42 obtains an actual position in the X-axis direction of the wheel head 70 from a detection signal of an encoder 68E of the wheel head drive device 68 to perform feedback. The drive unit 46 obtains an actual position in the Z-axis direction of the worktable 65 from a detection signal of an encoder 66E of the worktable drive device 66 to perform feedback control.

Specifically, the encoder 66E and the drive unit 46 detect the amount by which the worktable 65 has been moved. The encoder 68E and the drive unit 42 detect the amount by which the wheel head 70 has been moved toward the worktable 65. If the amount by which the intended element is to be moved, namely the amount indicated by a command signal or a control signal, matches the amount by which the intended element has actually been moved, namely the amount detected by the encoder and the drive unit, a completion signal is sent to the numerical control device 40.

As shown in FIG. 5, the camshaft 18, or the workpiece W, is held between the centers 72, 73 such that the workpiece rotation axis PW, which is the central axis of the camshaft 18 having the composite cams 10, matches the spindle rotation axis, which is the rotation axis of the spindle 74.

In the cam grinding machine 30 described in the present embodiment, the spindle rotation axis (which matches the workpiece rotation axis PW in the example of FIG. 5) and the grinding wheel rotation axis PT, or the rotation axis of the grinding wheel T, are located on the same horizontal plane STM.

The control that is performed by a control device 64 will be described. The control device 64 is formed by components located in the range surrounded by phantom line in FIG. 4. The control device 64 controls each drive device that performs grinding of the first cam 12 and the second cam 14. That is, the control device 64 controls the spindle drive device 76 serving as the workpiece rotating device, the worktable drive device 66 serving as the traverse moving device, and the wheel head drive device 68 serving as the plunge moving device.

Figure 6:
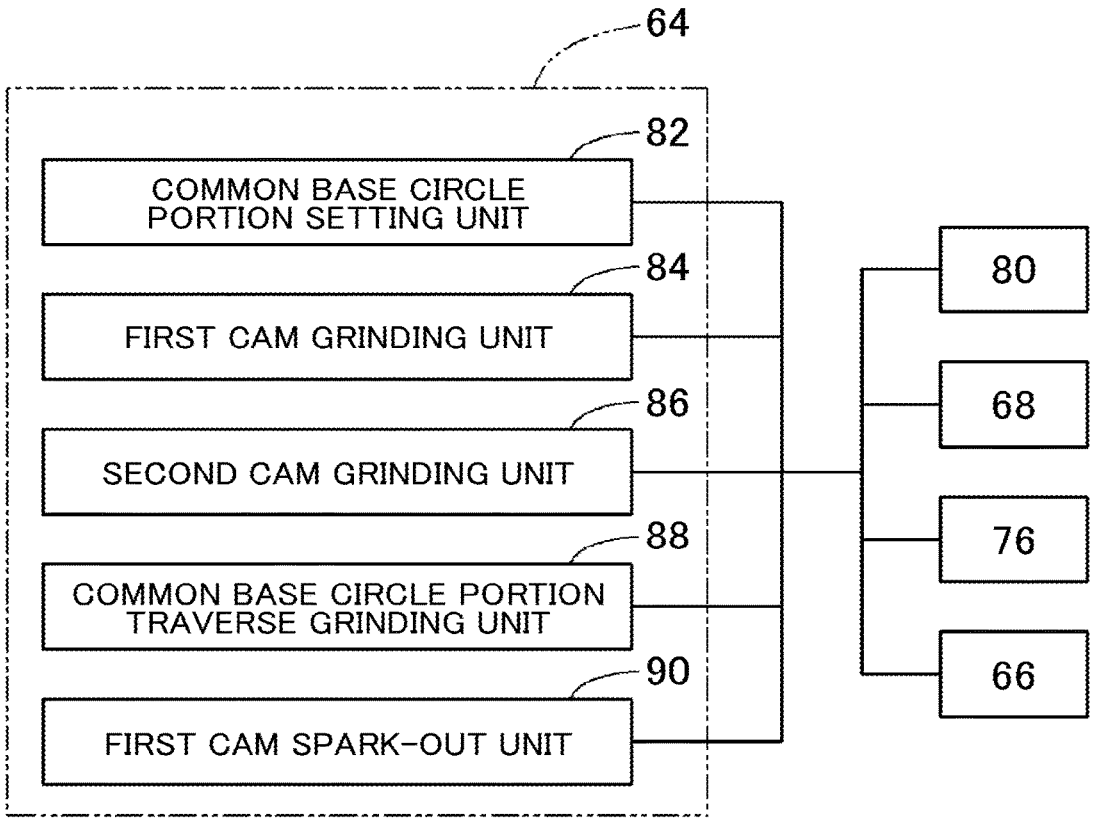
FIG. 6 is a block diagram showing control functions of a control device.

As shown in FIG. 6, the control device 64 includes control function units that control these drive devices. That is, the control device 64 includes a common base circle portion setting unit 82, a first cam grinding unit 84, a second cam grinding unit 86, a common base circle portion traverse grinding unit 88, and a first cam spark-out unit 90.

The common base circle portion setting unit 82 is a function unit that sets the common base circle portion C of the first and second cams 12, 14 by a program for the common base circle setting step in a control process flow described below.

The first cam grinding unit 84 is a function unit that performs grinding of the first cam 12 by a program for the first cam grinding step described below. The second cam grinding unit 86 is a function unit that performs grinding of the second cam 14 by a program for the second cam grinding step described below.

The common base circle portion traverse grinding unit 88 is a function unit that performs removal of the unground part produced by the first cam grinding step and the second cam grinding step by a program for the common base circle portion traverse grinding step described below.

The first cam spark-out unit 90 is a function unit that performs spark-out of the first cam 12 after the common base circle portion traverse grinding step in a second embodiment described below by a program for the first cam spark-out grinding step described below.

Figure 7:
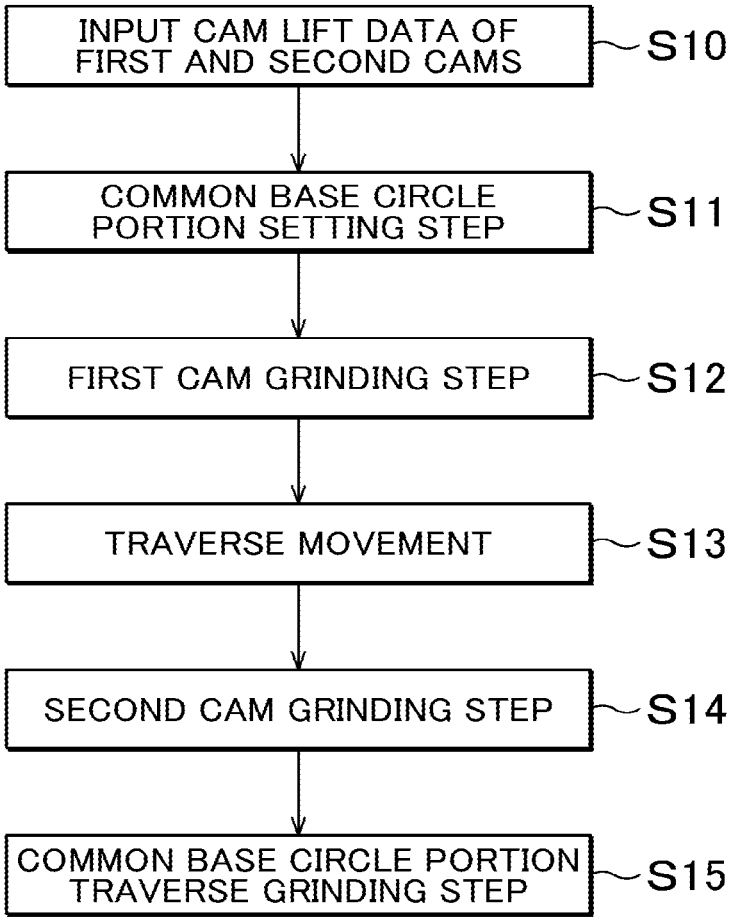
FIG. 7 shows a process flow of a first embodiment which is performed by the control device.
Figure 8:
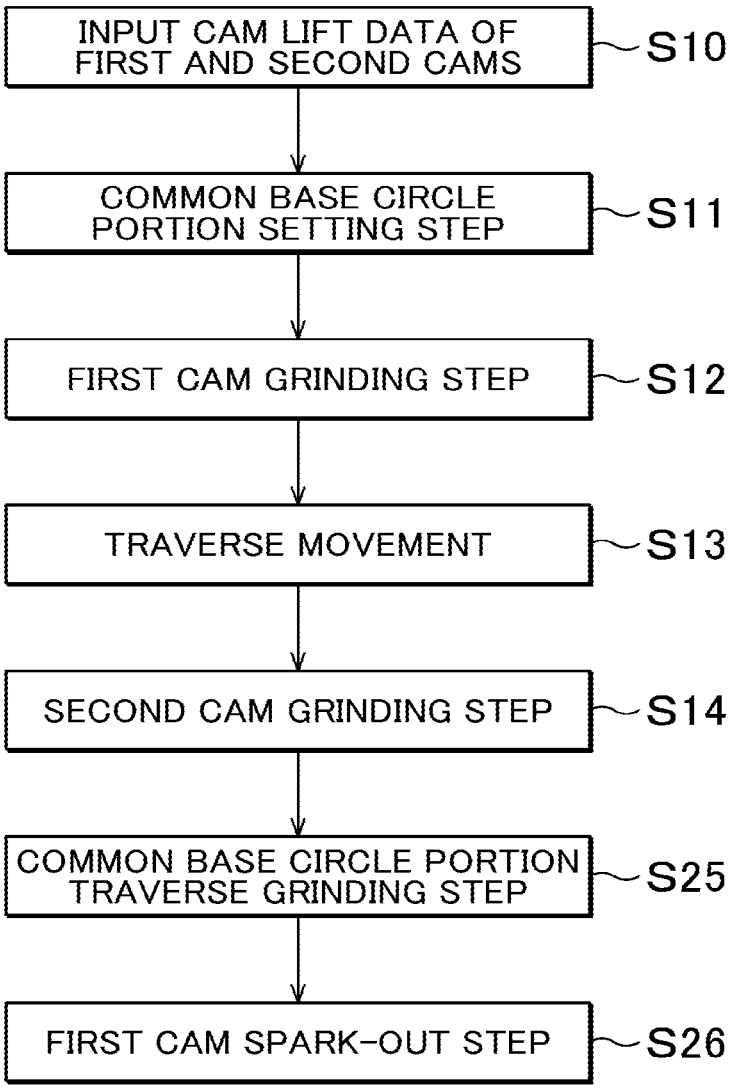
FIG. 8 shows a process flow of a second embodiment which is performed by the control device.

The control process flow that controls operation of the drive devices by using the function units include a control process flow of the first embodiment shown in FIG. 7 and a control process flow of the second embodiment shown in FIG. 8. Each of the embodiments will be described below.

First, the first embodiment shown in FIG. 7 will be described. As shown in the control process flow of FIG. 7, the first cam lift data on the outer profile of the first cam 12 shown in FIG. 1 and the second cam lift data on the outer profile of the second cam 14 shown in FIG. 1 are first read in step S10 as described above.

Next, the common base circle portion C of the first and second cams 12, 14 is obtained in the common base circle portion setting step S11. The common base circle portion C is obtained from the first cam lift data, or data on setting of the lift with respect to the rotation angle of the first cam 12 shown in FIG. 1, and the second cam lift data, or data on setting of the lift with respect to the rotation angle of the second cam 14 shown in FIG. 1. The angular range in which the outer peripheral surface of the first base circle portion C1 of the first cam 12 and the outer peripheral surface of the second base circle portion C2 of the second cam 14 shown in FIG. 1 have a common surface with a radius r is obtained as the common base circle portion C. The common base circle portion setting step S11 need only be performed by the time the second cam grinding step described below is completed.

Figure 16:
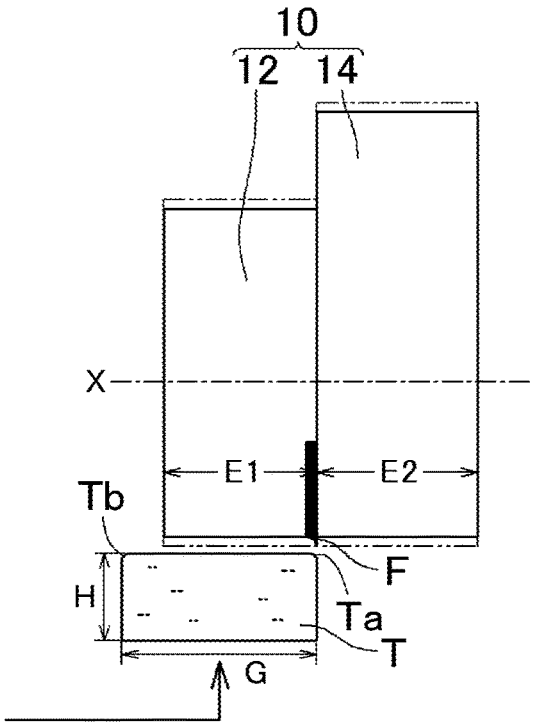
FIG. 16 is an illustration of grinding of the first cam.

Then, grinding of the first cam 12 is performed in the first cam grinding step S12. FIG. 16 is a schematic view illustrating grinding that is performed in the first cam grinding step. The control device 64 controls the worktable drive device 66 and the wheel head drive device 68 to move the grinding wheel T to the position facing the outer peripheral surface of the first cam 12. The control device 64 controls the spindle drive device 76 and the wheel head drive device 68 to perform plunge grinding of the first cam 12.

Figure 9:
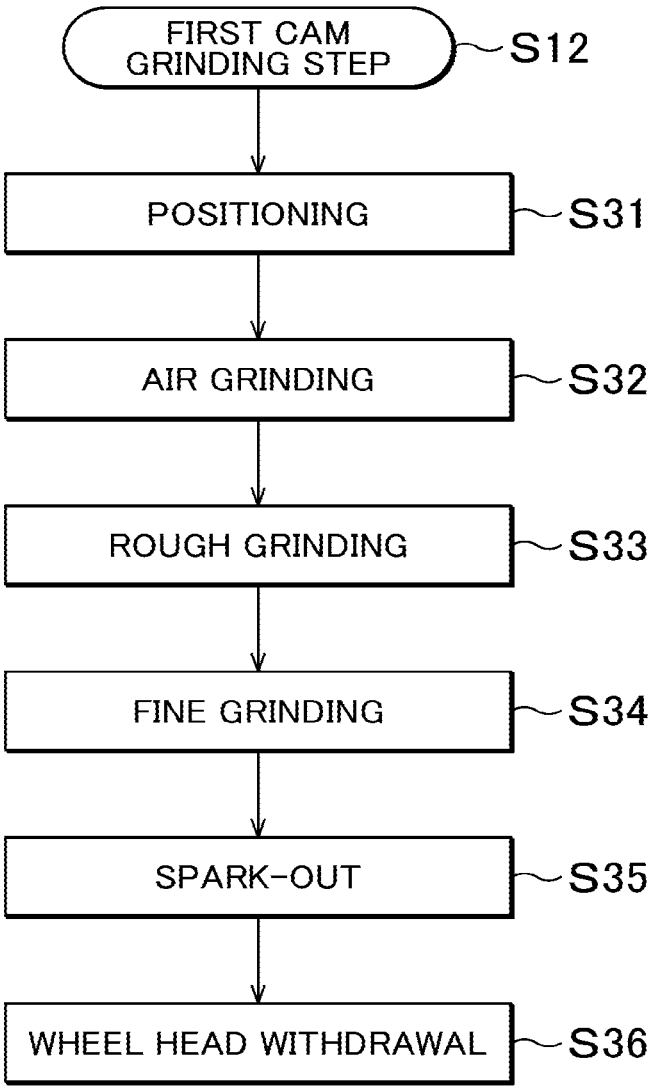
FIG. 9 shows a detailed process flow of a first cam grinding step.

FIG. 9 shows a detailed process flow of the first cam grinding step S12. As shown in FIG. 9, grinding of the first cam 12 is performed in order of positioning S31, air grinding S32, rough grinding S33, fine grinding S34, spark-out S35, and wheel head withdrawal S36. In the positioning S31, the worktable 65 is moved to the right so that the right end of the first cam 12 is located at the position corresponding to the right end of the grinding wheel T in the traverse direction in FIG. 16 (lateral direction in FIG. 16). The wheel head 70 is advanced so that the grinding wheel T is located at a position away from the axis x of the composite cam 10 toward the wheel head 70 by an amount corresponding to the sum of the radius r, the infeed J for the air grinding, the infeed K for the rough grinding, and the infeed M for the fine grinding in the plunge direction (vertical direction in FIG. 16).

In the positioning S31, the right end of the grinding wheel T is positioned at the right end of the first cam 12 in the traverse direction (lateral direction) in FIG. 16, and the grinding wheel T is positioned at the position away from the first cam 12 by an amount corresponding to the infeed J for the air grinding in the plunge direction (vertical direction). In the air grinding S32, the grinding wheel T is moved in the plunge direction by the amount corresponding to the infeed J for the air grinding, so that the grinding wheel T comes into contact with the outer peripheral surface of the first cam 12. In the rough grinding S33, the grinding wheel T contacting the outer peripheral surface of the first cam 12 is advanced in the plunge direction by an amount corresponding to the infeed K for the rough grinding and the rough grinding is performed. In the fine grinding S34, the grinding wheel T is advanced in the plunge direction by an amount corresponding to the infeed M for the fine grinding and the fine grinding is performed. Subsequently, in the spark-out S35, spark-out is performed until the amount of rotation of the spindle 74 reaches a predetermined value. After these steps are finished, in the wheel head withdrawal S36, the wheel head 70 is withdrawn in the plunge direction by an amount corresponding to the sum of the infeed J, the infeed K, and the infeed M to prepare for the subsequent second cam grinding step S14.

Referring back to FIG. 7, after the first cam grinding step S12 is finished, the traverse movement S13 is performed. The traverse movement is the movement of the grinding wheel T from the position of FIG. 16 to the position of FIG. 17. This is the operation of moving the worktable 65 to the right by an amount corresponding to the width G of the grinding wheel T in the traverse direction.

Figure 17:
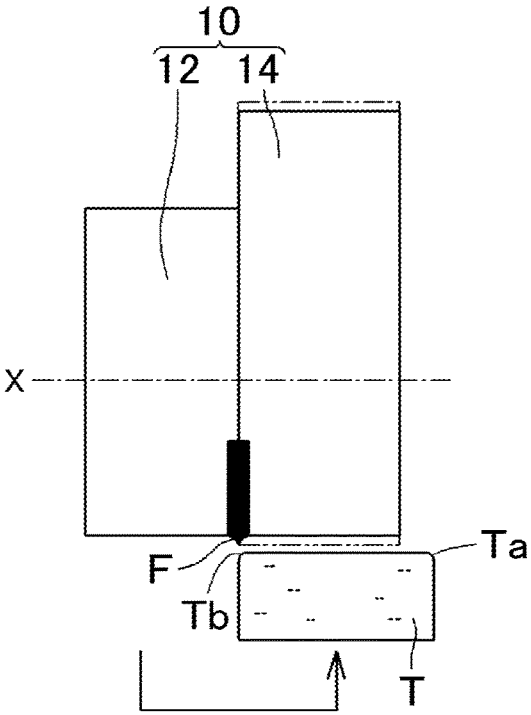
FIG. 17 is an illustration of grinding of the second cam.

Subsequently, the second cam grinding step S14 is performed. Grinding of the second cam 14 is performed in the second cam grinding step S14. FIG. 17 illustrates grinding that is performed in the second cam grinding step S14. The control device 64 controls the worktable drive device 66 and the wheel head drive device 68 to move the grinding wheel T to the position facing the outer peripheral surface of the second cam 14 through a path shown by arrow in FIG. 17. The control device 64 controls the spindle drive device 76 and the wheel head drive device 68 to perform plunge grinding of the second cam 14.

Figure 10:
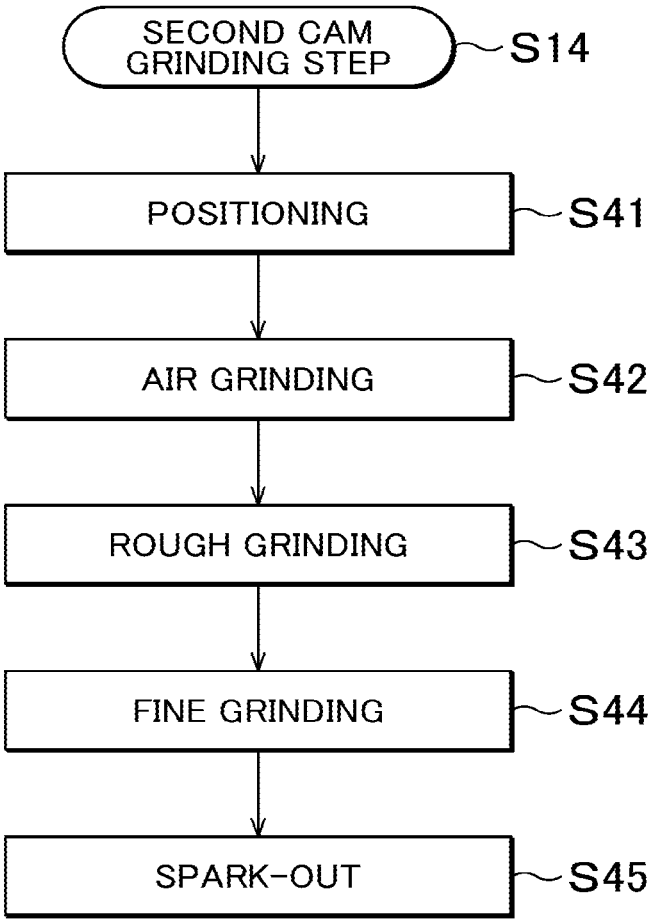
FIG. 10 shows a detailed process flow of a second cam grinding step.

FIG. 10 shows a detailed process flow of the second cam grinding step S14. As shown in FIG. 10, grinding of the second cam 14 is performed in order of positioning S41, air grinding S42, rough grinding S43, fine grinding S44, and spark-out S45. In the positioning S41, the grinding wheel T is positioned for the second cam grinding step S14 by the traverse movement S13. By this positioning, the left end of the grinding wheel T is positioned at the left end of the second cam 14 in the traverse direction. The grinding wheel T is located at a position away from the second cam 14 by an amount corresponding to the infeed J for the air grinding in the plunge direction. In the air grinding S42, the grinding wheel T is advanced in the plunge direction by an amount corresponding to the infeed J for the air grinding. In the rough grinding S43, the grinding wheel T is advanced in the plunge direction by an amount corresponding to the infeed K for the rough grinding. In the fine grinding S44, the grinding wheel T is advanced in the plunge direction by an amount corresponding to the infeed M for the fine grinding. Subsequently, in the spark-out S45, spark-out is performed until the amount of rotation of the spindle 74 reaches a predetermined value.

The infeed J for the air grinding in the first cam grinding step S12 and the second cam grinding step S14 is an amount that is larger than the maximum lift of the first cam 12 or the second cam 14 and that does not cause the grinding wheel T to interfere with the first cam 12 or the second cam 14 even if the worktable 65 is moved in the traverse direction with the wheel head 70 being located at the position before the air grinding. That is, the maximum lift is equal to the maximum value of the lift data minus the minimum value of the lift data. The minimum value of the lift data is the radius of the first base circle portion C1 or the second base circle portion C2.

In the air grinding, the rough grinding, the fine grinding, and the spark-out of the first cam grinding step S12 and the second cam grinding step S14, the wheel head 70 is advanced or withdrawn based on the first cam lift data or the second cam lift data in connection with the rotation angle of the spindle 74. This advancement and withdrawal of the wheel head 70 is made together with the operation of advancing the grinding wheel T in the plunge direction by an amount corresponding to the infeed.

Cam grinding in the first cam grinding step S12 and the second cam grinding step S14 is performed in three stages in order of rough grinding, fine grinding, and spark-out. This can reduce the time required for grinding. The cam grinding can be performed by only the fine grinding. In this case, however, it takes long to perform the cam grinding. The spark-out refers to a grinding process that does not involve feeding like plunge grinding. The workpiece W subjected to the fine grinding has deflection due to the machining. The spark-out is performed in order to perform grinding without involving feeding to eliminate the deflection. Namely, the spark-out is performed for improved grinding accuracy.

In the plunge grinding of the first cam 12 and the second cam 14 with the grinding wheel T in the first cam grinding step S12 and the second cam grinding step S14, the unground part F remains at the boundary between the first and second cams 12, 14. The black part in the figures represents the unground part F. The unground part F and the grinding allowances of the first and second cams 12, 14 which are shown by phantom lines in the figures are shown exaggerated in order to facilitate understanding.

After the second cam grinding step S14, the unground part F remaining at the boundary between the first and second cams 12, 14 is ground and removed in the common base circle portion traverse grinding step S15 shown in FIG. 7.

Figure 18:
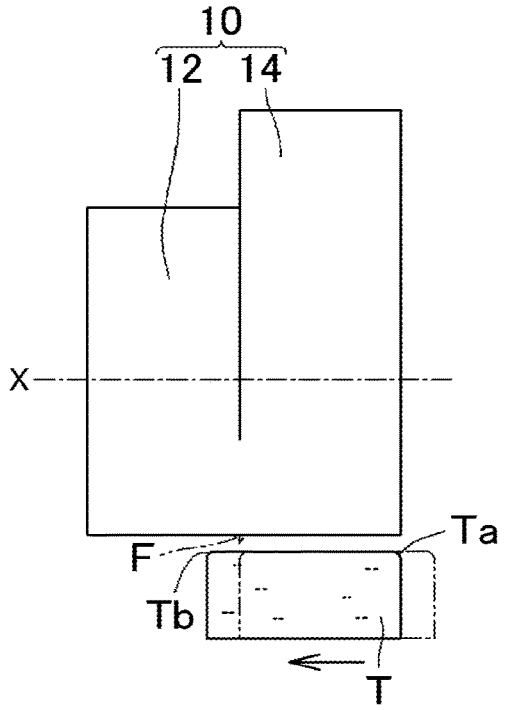
FIG. 18 is an illustration of the first embodiment, illustrating traverse grinding of a common base circle portion.

FIG. 18 is a schematic view illustrating grinding in the common base circle portion traverse grinding step S15. In the common base circle portion traverse grinding step S15, the worktable 65 is moved to the left in the traverse direction so that the right end Ta of the grinding wheel T is located at the position corresponding to the right end of the second cam 14. The left end Tb of the grinding wheel T is thus located at a position beyond the unground part F remaining at the boundary between the first and second cams 12, 14 to the left. In order to perform this operation of moving the worktable 65 to the left, the control device 64 controls the worktable drive device 66 to make the traverse movement of the grinding wheel T as shown by arrow in FIG. 19.

In the common base circle portion traverse grinding step S15, since the angle of the common base circle portion C is 180 degrees or less, the rotational speed n5 of the spindle 74 in this step S15 is lower than the rotational speed n3 of the spindle 74 in the fine grinding, and the speed of the traverse movement in this step S15 is higher than that of the traverse movement that is made after the first cam grinding step and before the second cam grinding step.

The traverse movement is made so that the left end Tb of the grinding wheel T is located at a position beyond the unground part F remaining at the boundary between the first and second cams 12, 14 to the left. At the same time, the spindle drive device 76 is controlled to rotate the first and second cams 12, 14 in the angular range of the common base circle portion C, thereby removing the unground part F at the boundary and performing spark-out of the common base circle portion C. The unground part F is removed in this manner.

In the traverse movement of the grinding wheel T described above, with the grinding wheel T being located at a counterclockwise end CA of the common base circle portion C in FIG. 1, the first and second cams 12, 14 are rotated in the counterclockwise direction and moved to the right in the traverse direction with respect to the grinding wheel T. With the grinding wheel T being located at a counterclockwise end CB of the common base circle portion C and having been moved by an amount corresponding to the width G of the grinding wheel T minus the width of the unground part F by the traverse movement, the wheel head 70 is quickly withdrawn in order to prevent the cam height varying profile portion D1 of the first cam 12 from being ground by the grinding wheel T.

It is desirable that, when the traverse movement of the grinding wheel T in FIG. 18 is made so that the left end Tb of the grinding wheel T is located at a position beyond the unground part F to the left, the right end Ta of the grinding wheel T not be located at a position beyond the right end of the second cam 14 to the left. The ground surface of the second cam 14 ground in the second cam grinding step is thus not affected.

The control process flow of the second embodiment shown in FIG. 8 will be described below. In the control process flow of the second embodiment, the same steps as those of the control process flow of the first embodiment shown in FIG. 7 are denoted by the same reference characters and detailed description thereof will be omitted. The step S10 of inputting the cam lift data of the first and second cams, the common base circle portion setting step S11, the first cam grinding step S12, the traverse movement S13, and the second cam grinding step S14 are the same as those of the control process flow of the first embodiment.

As in the common base circle portion traverse grinding step S15 of the first embodiment, the unground part F remaining at the boundary between the first and second cams 12, 14 is ground and removed in the common base circle portion traverse grinding step S25 of the second embodiment shown in FIG. 8. However, the common base circle portion traverse grinding step S25 of the second embodiment is different from the common base circle portion traverse grinding step S15 of the first embodiment in the range of the traverse movement that is made to remove the unground part F.

Figure 19:
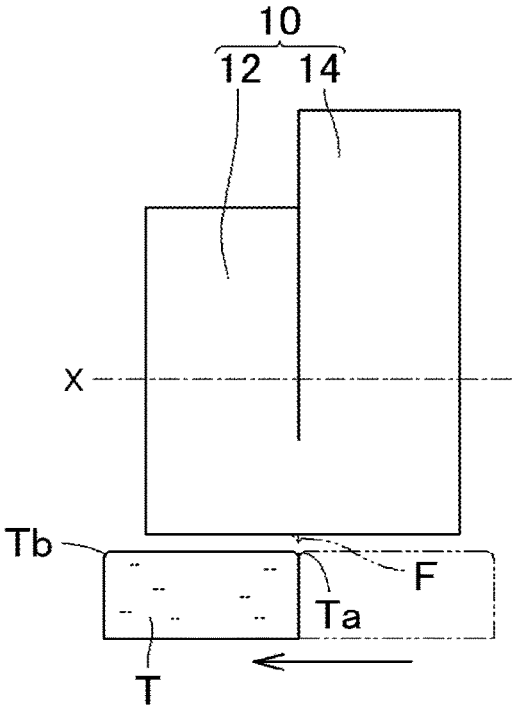
FIG. 19 is an illustration of the second embodiment, illustrating traverse grinding of the common base circle portion.

FIG. 19 is a schematic view illustrating grinding of the common base circle portion traverse grinding step S25. As in the first embodiment, the control device 64 first controls the spindle drive device 76 to position the grinding wheel T such that the grinding wheel T contacts the common base circle portion C of the second cam 14. In this state, the control device 64 controls the worktable drive device 66 to make the traverse movement of the grinding wheel T as shown by arrow in FIG. 19.

In the second embodiment, this traverse movement is made so that the left end Tb of the grinding wheel T is located at a position beyond the unground part F remaining at the boundary between the first and second cams 12, 14 to the left and that the right end Ta of the grinding wheel T is located at the position corresponding to the left end of the second cam 14. In this traverse movement, the control device 64 controls the spindle drive device 76 and the wheel head drive device 68 to rotate the first and second cams 12, 14 in the angular range of the common base circle portion C obtained in the common base circle portion setting step S11, thereby removing the unground part F at the boundary and performing spark-out of the common base circle portion C. The unground part F is removed in this manner. As used herein, the term "traverse grinding" refers to removal of the unground part F and spark-out in the range of the common base circle portion C by the traverse movement of the grinding wheel T.

In the second embodiment, the first cam spark-out step S26 is performed after the traverse grinding is performed in the common base circle portion traverse grinding step S25.

In the first cam spark-out step S26, the grinding wheel T is located at the counterclockwise end CB of the common base circle portion C and is moved in the traverse direction by an amount corresponding to the width G of the grinding wheel T. In this state, the wheel head 70 is advanced or withdrawn based on the lift data of the first cam 12 according to the rotation angle of the spindle 74 to perform spark-out of the first cam 12. A tool mark formed on the common base circle portion C in the common base circle portion traverse grinding step S25 is removed only from the first cam 12 by the spark-out of the first cam 12.

After the spark-out is finished, the wheel head 70 is quickly withdrawn in order to prevent the cam height varying profile portion D1 of the first cam 12 from being ground by the grinding wheel T. In the first embodiment, the grinding wheel T is moved in the traverse direction by a small amount in the common base circle portion C. In the second embodiment, however, the grinding wheel T is moved in the traverse direction by a large amount in the common base circle portion C. Accordingly, if there is a limit on the speed of the traverse movement, the rotational speed of the spindle 74 is reduced as compared to the first embodiment.

Figure 11:
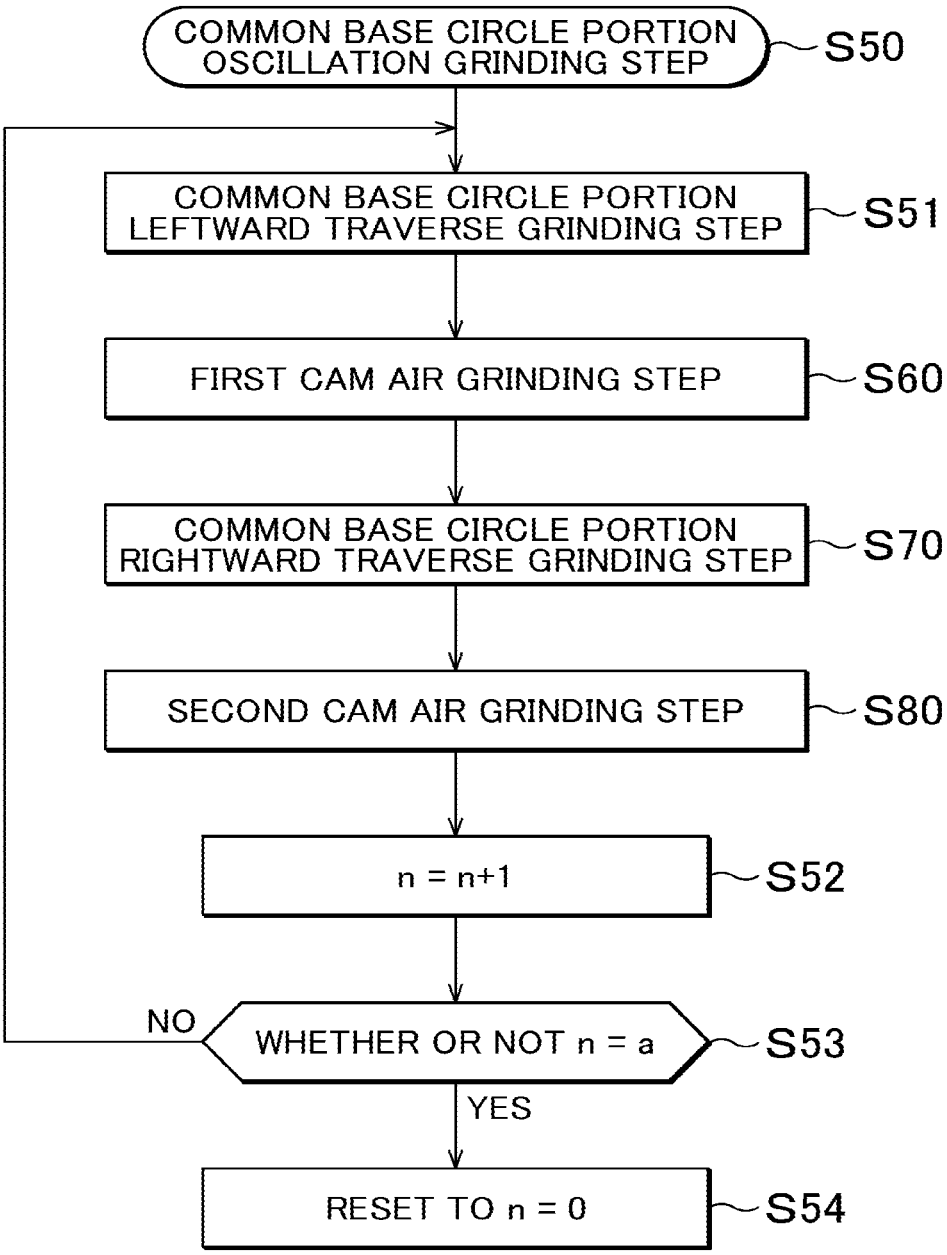
FIG. 11 shows a detailed process flow of a common base circle portion oscillation grinding step.

A third embodiment shown in FIG. 11 will be described below. In the third embodiment, steps S10 to S14 in the control process flow of FIG. 7 are performed as in the first embodiment, but the common base circle portion traverse grinding step S15 is replaced with a common base circle portion oscillation grinding step S50 shown in FIG. 11. In the common base circle portion traverse grinding step S25 of the second embodiment, the traverse grinding of the common base circle portion C is performed by a single transverse movement to the left. In the common base circle portion oscillation grinding step S50 of the third embodiment, however, traverse grinding of the common base circle portion C is performed by a plurality of reciprocating transverse movements.

The common base circle portion oscillation grinding step S50 of the third embodiment will be described with reference to FIG. 11. The common base circle portion oscillation grinding step S50 is performed in order of a common base circle portion leftward traverse grinding step S51, a first cam air grinding step S60, a common base circle portion rightward traverse grinding step S70, a second cam air grinding step S80, a count-up step S52 (n=n+1), a count value determining step S53 (n=a), and a count value reset step S54 (n=0). If it is determined in the count value determining step S53 that the count value n has not reached the value a, steps S51 to S53 are performed again. If it is determined in the count value determining step S53 that the count value n is equal to the value a, the common base circle portion oscillation grinding step S50 is terminated.

Figure 12:
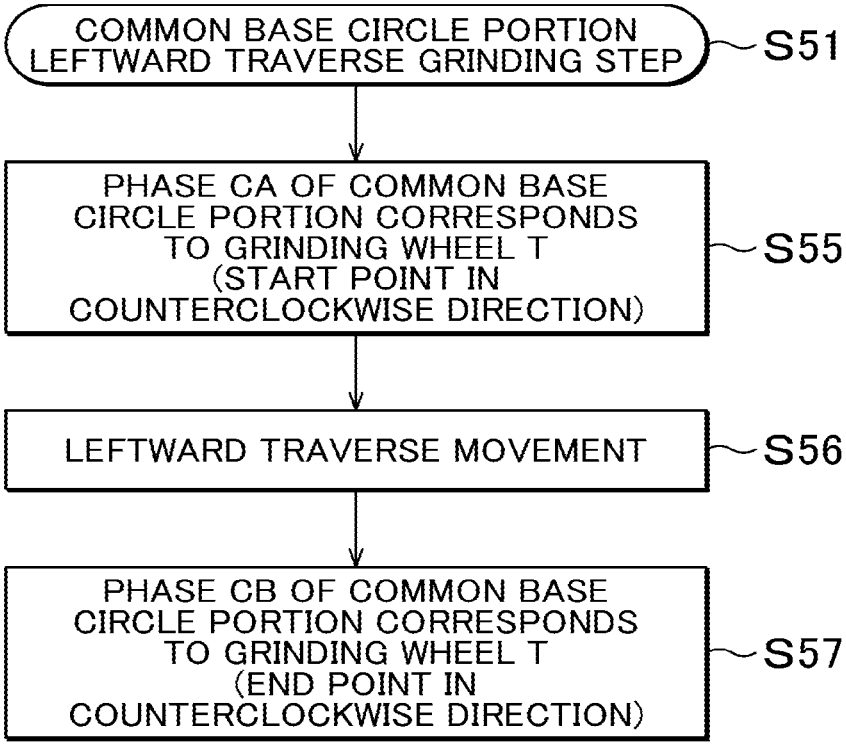
FIG. 12 shows a detailed process flow of a common base circle portion leftward traverse grinding step.

The common base circle portion leftward traverse grinding step S51 will be described with reference to FIG. 12. The common base circle portion leftward traverse grinding step S51 is performed in order of steps S55, S56, and S57. In the step S55, the phase CA of the common base circle portion C corresponds to the grinding wheel T, and the left end of the grinding wheel T corresponds to the left end of the second cam 14. In the leftward traverse movement step S56, the first and second cams 12, 14 are rotated in the counterclockwise direction and are also moved to the left with respect to the grinding wheel T to perform traverse grinding. In the step S57, the phase CB of the common base circle portion C corresponds to the grinding wheel T, and the right end of the grinding wheel T corresponds to the right end of the first cam 12.

Figure 13:
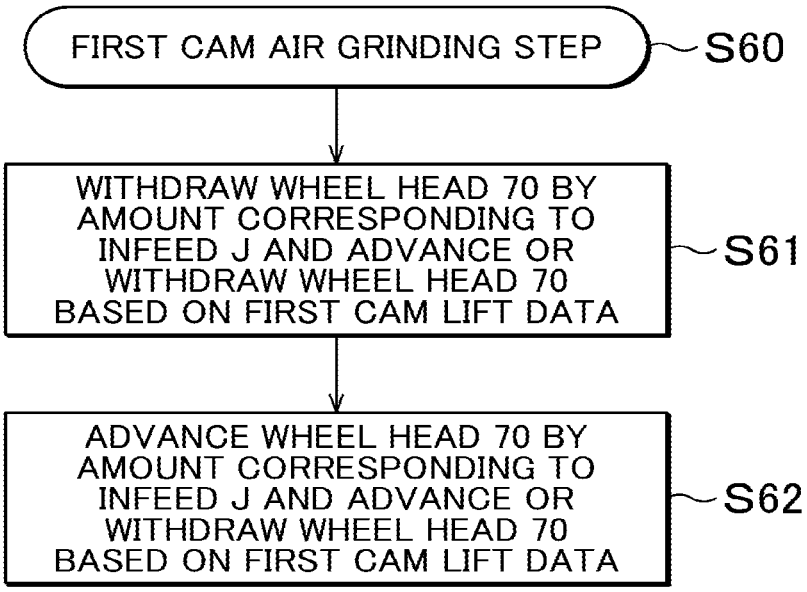
FIG. 13 shows a detailed process flow of a first cam air grinding step.

The first cam air grinding step S60 will be described with reference to FIG. 13. The first cam air grinding step S60 is performed in order of a withdrawing air grinding step S61 and an advancing air grinding step S62. In the withdrawing air grinding step S61, the wheel head 70 is withdrawn by an amount corresponding to the infeed J, and the wheel head 70 is advanced or withdrawn based on the first cam lift data with the first and second cams 12, 14 being rotated in the counterclockwise direction. In the advancing air grinding step S62, the wheel head 70 is advanced by the amount corresponding to the infeed J, and the wheel head 70 is advanced or withdrawn based on the first cam lift data with the first and second cams 12, 14 being rotated in the counterclockwise direction.

Figure 14:
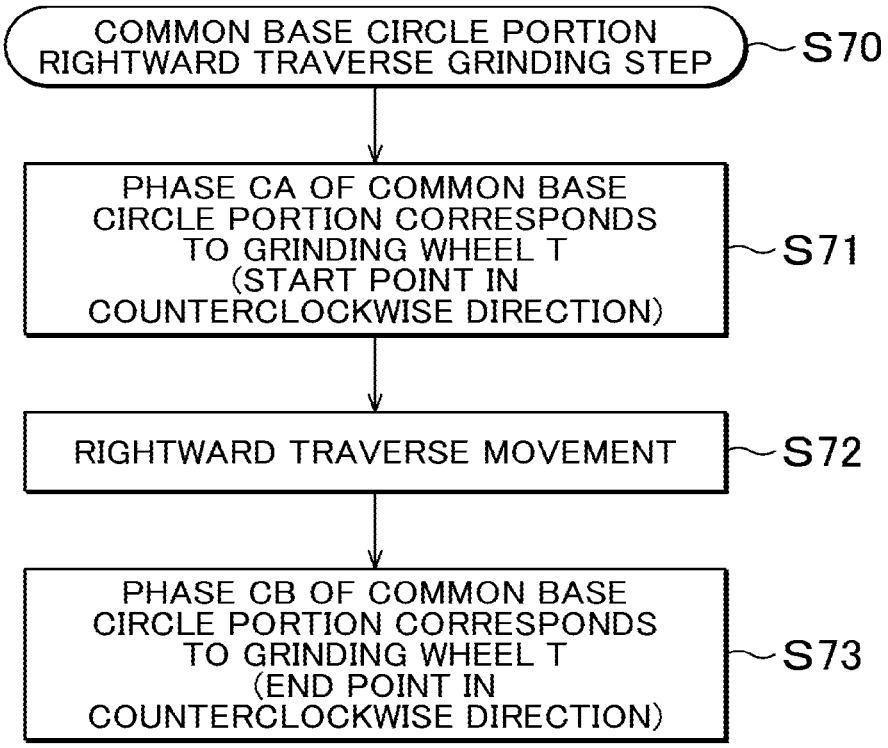
FIG. 14 shows a detailed process flow of a common base circle portion rightward traverse grinding step.

The common base circle portion rightward traverse grinding step S70 will be described with reference to FIG. 14. The common base circle portion rightward traverse grinding step S70 is performed in order of steps S71, S72, and S73. In the step S71, the phase CA of the common base circle portion C corresponds to the grinding wheel T, and the right end of the grinding wheel T corresponds to the right end of the second cam 14. In the rightward traverse movement step S72, the first and second cams 12, 14 are rotated in the counterclockwise direction and are also moved to the right with respect to the grinding wheel T to perform traverse grinding. In the step S73, the phase CB of the common base circle portion C corresponds to the grinding wheel T, and the left end of the grinding wheel T corresponds to the left end of the second cam 14.

Figure 15:
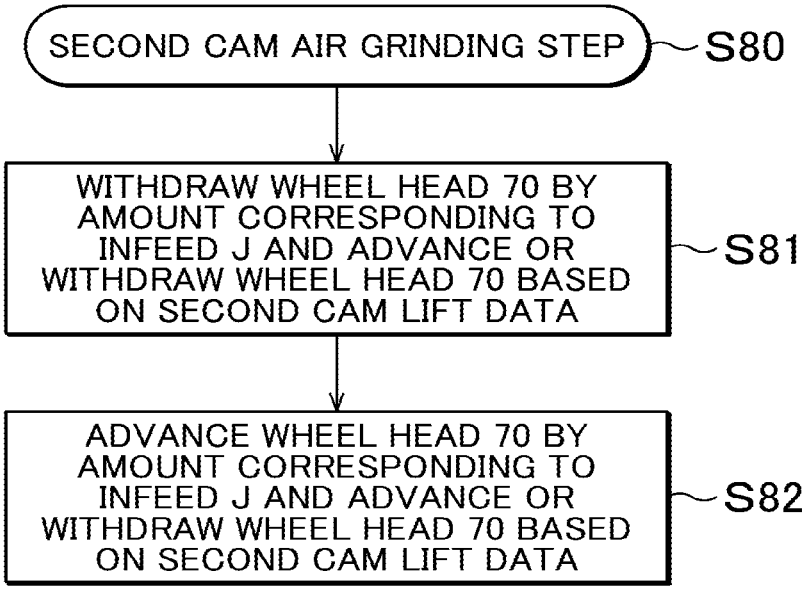
FIG. 15 shows a detailed process flow of a second cam air grinding step.

The second cam air grinding step S80 will be described with reference to FIG. 15. The second cam air grinding step S80 is performed in order of a withdrawing air grinding step S81 and an advancing air grinding step S82. In the withdrawing air grinding step S81, the wheel head 70 is withdrawn by an amount corresponding to the infeed J, and the wheel head 70 is advanced or withdrawn based on the second cam lift data with the first and second cams 12, 14 being rotated in the counterclockwise direction. In the advancing air grinding step S82, the wheel head 70 is advanced by the amount corresponding to the infeed J, and the wheel head 70 is advanced or withdrawn based on the second cam lift data with the first and second cams 12, 14 being rotated in the counterclockwise direction.

Figure 20:
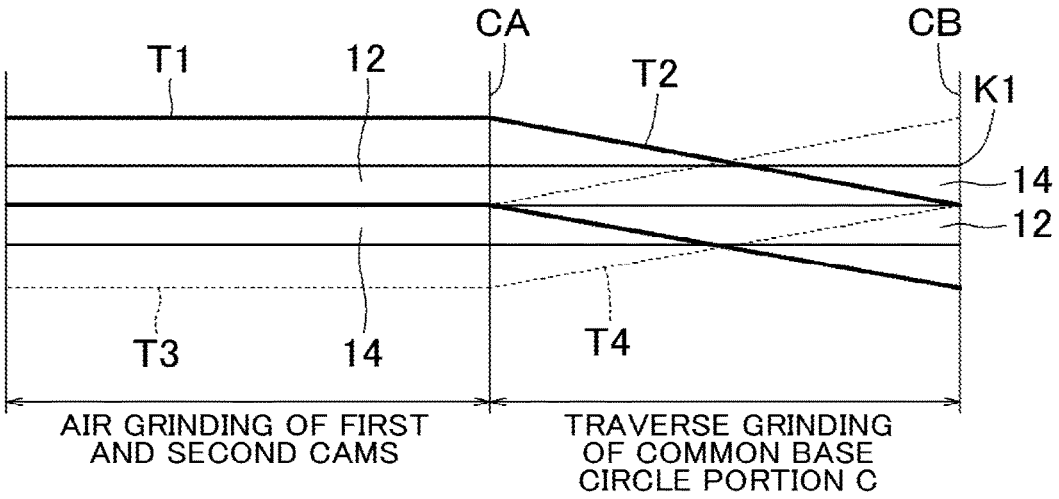
FIG. 20 is a developed diagram conceptually sowing tracks of a grinding wheel with respect to the first and second cams in a third embodiment.
Figure 21:
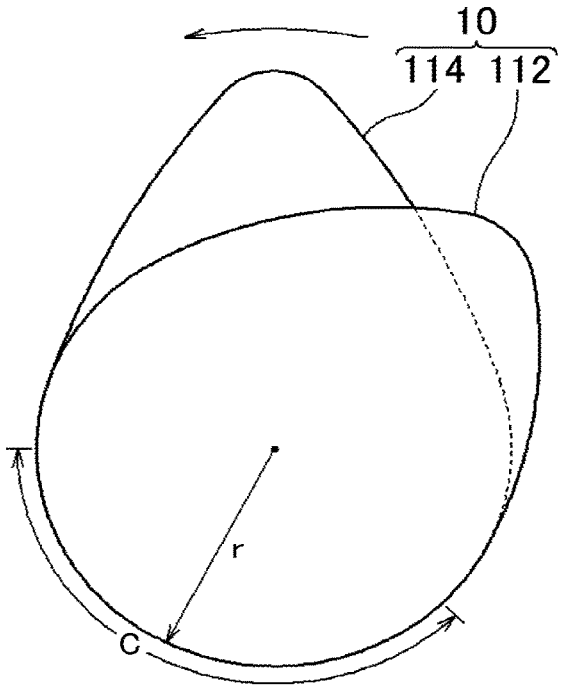
FIG. 21 is a schematic view of a composite cam as viewed in the direction of a cam axis, illustrating a prior art.
Figure 22:
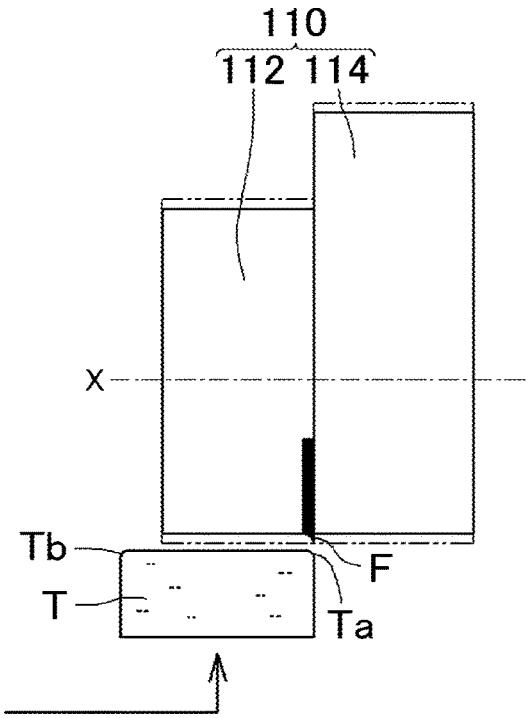
FIG. 22 is a side view of a first cam and a second cam of the composite cam as viewed in a direction perpendicular to the cam axis, illustrating grinding of the first cam.
Figure 23:
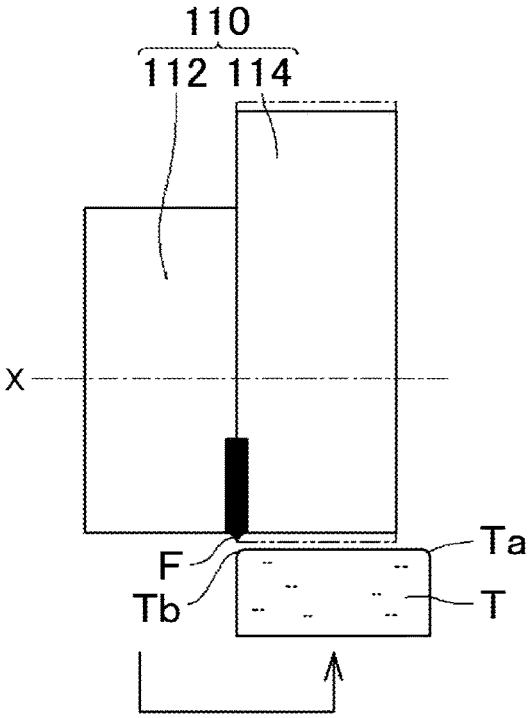
FIG. 23 is a diagram illustrating grinding of the second cam.

The track of the grinding wheel T with respect to the first cam 12 and the second cam 14 of the third embodiment will be described with reference to FIG. 20. FIG. 20 is a diagram showing the outer peripheries of the first and second cams 12, 14 developed in a planar manner.

The grinding wheel T moves along a track T2 in the leftward traverse movement step S56. The grinding wheel T moves along a track T3 in the withdrawing air grinding step S61 and the advancing air grinding step S62. The grinding wheel T moves along a track T4 in the rightward traverse movement step S72. The grinding wheel T moves along a track T1 in the withdrawing air grinding step S81 and the advancing air grinding step S82.

According to the above embodiments, the unground part F produced at the boundary between the first and second cams 12, 14 in the first cam grinding step S12 and the second cam grinding step S14 is removed by the common base circle portion traverse grinding steps S15, S25. Accordingly, when the tappet 22 relatively moves between the first and second cams 12, 14, the tappet 22 does not get over the unground part F as in conventional examples, and the operation of the tappet 22 is performed smoothly. This eliminates the need for frequent replacement of the grinding wheel and early dressing of the grinding wheel.

According to the above embodiments, in the common base circle portion traverse grinding step S15, S25 that is performed after the second cam grinding step S14, the grinding wheel T is moved in the traverse direction from the second cam 14 ground in the second cam grinding step S14 toward the position of the unground part without being moved in the plunge direction in both of the first and second embodiments. This produces an accurately finished cam surface with the unground part removed therefrom. In the case where the grinding wheel T is withdrawn in the plunge direction, moved in the traverse direction, and advanced in the plunge direction in order to move the grinding wheel T to the position of the unground part after the second cam grinding step S14, a positional deviation of several micrometers may be caused in the plunge direction, and the unground part may not be completely removed.

In the first embodiment, the amount by which the grinding wheel T is moved in the traverse direction in the common base circle portion traverse grinding step S15 is as small as the width of the unground part F. The machining time is therefore short. On the other hand, since the grinding wheel T is moved in the traverse direction with the spindle 74 being rotated, a tool mark is formed in a helical pattern in the common base circle portion C. However, since the depth of the tool mark is as shallow as several micrometers, the tool mark affects the tappet less than the unground part F with a size of several micrometers.

In the second embodiment, the amount by which the grinding wheel T is moved in the traverse direction in the common base circle portion traverse grinding step S25 is as large as the width G of the grinding wheel T. The machining time is therefore long. However, spark-out of the first cam 12 is performed after spark-out of the common base circle portion C. This is advantageous in that a tool mark formed on the common base circle portion C of the first cam 12 is removed.

In the third embodiment, since the traverse grinding of the common base circle portion C is performed repeatedly, the machining time is long. However, since a plurality of tool marks are formed on the common base circle portion C such that the tool marks are shifted from each other, the tool marks are less noticeable.

In the first to third embodiments described above, traverse grinding and oscillation grinding of the common base circle portion C are performed only after spark-out of the second cam. This can reduce the machining time as compared to the case where traverse grinding and oscillation grinding of the common base circle portion C are performed even after rough grinding and fine grinding.

Although the present invention is described above with respect to the specific embodiments, the present invention can be carried out in various other forms.

For example, in the above embodiments, the first cam and the second cam have the same width in the axial direction. However, the first cam and the second cam may have different widths in the axial direction. It should be noted that, in this case, the first and second cams are subjected to different surface pressures from the grinding wheel T in the plunge grinding.

For example, the second embodiment is described with respect to an example in which spark-out of the first cam 12 is performed in the first grinding step S12 and also after the common base circle portion traverse grinding step S25. In other embodiments, spark-out of the first cam 12 may not be performed in the first grinding step S12 and may be performed after the common base circle portion traverse grinding step S25. This is advantageous because the overall machining time can be reduced.

The above embodiments are described with respect to the case where the first cam 12 is a cam for low speeds and the second cam 14 is a cam for high speeds. However, the first cam 12 may be a cam for high speeds and the second cam 14 may be a cam for low speeds.

What is claimed is:

1. A cam grinding machine that grinds a composite cam, wherein the composite cam includes a first cam that has a first base circle portion having a first radius and a fixed lift height from a central axis to its outer peripheral surface, and a first cam portion having a varying lift height from the central axis to its outer peripheral surface, and a second cam that has a second base circle portion having the first radius and the fixed lift height from the central axis to its outer peripheral surface, and a second cam portion having a varying lift height from the central axis to its outer peripheral surface, the first cam and the second cam are coaxially disposed so as to adjoin each other in an axial direction, the first cam and the second cam have different shapes from each other, the shape of the first cam corresponding to first cam lift data and the shape of the second cam corresponding to second cam lift data, and at least a part of the outer peripheral surface of the first base circle portion and at least a part of the outer peripheral surface of the second base circle portion are flush with each other to form a common base circle portion, the cam grinding machine comprising:

a base unit that serves as a base;

a spindle device placed over the base unit and including a workpiece rotating device that rotatably supports the composite cam about the central axis;

a grinding wheel device placed over the base unit and including a rotary grinding wheel;

a traverse moving device that can reciprocate the grinding wheel relative to the composite cam in the axial direction;

a plunge moving device that can move the grinding wheel relative to the composite cam in a direction crossing the axial direction; and a control device that controls the workpiece rotating device, the traverse moving device, and the plunge moving device; wherein the control device includes a common base circle portion setting unit that obtains an angular range of the common base circle portion formed by at least the part of the outer peripheral surface of the first base circle portion and at least the part of the outer peripheral surface of the second base circle portion being flush with each other, based on the first cam lift data in which a lift with respect to a rotation angle of the first cam is set, and the second cam lift data in which a lift with respect to a rotation angle of the second cam is set, a first cam grinding unit that controls the plunge moving device and the traverse moving device to move the grinding wheel to a position facing the outer peripheral surface of the first cam, and controls the workpiece rotating device and the plunge moving device to grind the first cam, a second cam grinding unit that, after the grinding of the first cam, controls the plunge moving device and the traverse moving device to move the grinding wheel to a position facing the outer peripheral surface of the second cam, and controls the workpiece rotating device and the plunge moving device to grind the second cam, and a common base circle portion traverse grinding unit that, after the grinding of the second cam, controls the traverse moving device to move the grinding wheel from a position of the second cam to a first position beyond a boundary between the first and second cams in a traverse direction in a first direction, controls the workpiece rotating device to rotate the composite cam within the angular range of the common base circle portion with respect to the grinding wheel to perform a first traverse grinding of the common base circle portion, controls the traverse moving device to move the grinding wheel from a position of the second cam to a second position beyond the boundary between the first and second cams in the traverse direction in a second direction opposite to the first direction, and controls the workpiece rotating device to rotate the composite cam within the angular range of the common base circle portion with respect to the grinding wheel to perform a second traverse grinding of the common base circle portion.

2. The cam grinding machine according to claim 1, wherein the grinding of the first cam using the first cam grinding unit comprises rough grinding and fine grinding, the grinding of the second cam using the second cam grinding unit comprises rough grinding, fine grinding, and spark-out, and the traverse grinding of the common base circle portion is performed after the spark-out of the second cam.

3. The cam grinding machine according to claim 2, wherein the common base circle portion traverse grinding unit of the control device moves the grinding wheel in the traverse direction in a range from the position of the second cam to a position of the first cam beyond the boundary between the first and second cams, and the control device further includes a first cam spark-out unit that, after the traverse grinding of the common base circle portion, controls the workpiece rotating device and the plunge moving device to perform spark-out of the first cam with the grinding wheel.

4. The cam grinding machine according to claim 1, wherein the traverse grinding in the common base circle portion traverse grinding unit is oscillation grinding in which the grinding wheel is reciprocated in the axial direction between the first and second cams.

5. A cam grinding method for grinding a composite cam, wherein the composite cam includes a first cam that has a first base circle portion having a first radius and a fixed lift height from a central axis to its outer peripheral surface, and a first cam portion having a varying lift height from the central axis to its outer peripheral surface, and a second cam that has a second base circle portion having the first radius and the fixed lift height from the central axis to its outer peripheral surface, and a second cam portion having a varying lift height from the central axis to its outer peripheral surface, the first cam and the second cam are coaxially disposed so as to adjoin each other in an axial direction, the first cam and the second cam have different shapes, the shape of the first cam corresponding to first cam lift data and the shape of the second cam corresponding to second cam lift data, and at least a part of the outer peripheral surface of the first base circle portion and at least a part of the outer peripheral surface of the second base circle portion are flush with each other to form a common base circle portion, the cam grinding method comprising:

a common base circle portion setting step of obtaining an angular range of the common base circle portion formed by at least the part of the outer peripheral surface of the first base circle portion and at least the part of the outer peripheral surface of the second base circle portion being flush with each other, based on the first cam lift data in which a lift with respect to a rotation angle of the first cam is set, and the second cam lift data in which a lift with respect to a rotation angle of the second cam is set;

a first cam grinding step of performing plunge grinding of the first cam with the grinding wheel based on the first cam lift data, a second cam grinding step of, after the first cam grinding step, performing plunge grinding of the second cam with the grinding wheel based on the second cam lift data; and a common base circle portion traverse grinding step of, after the second cam grinding step, moving the grinding wheel from a position of the second cam to a first position beyond a boundary between the first and second cams in a traverse direction in a first direction, a rotating the composite cam within the angular range of the common base circle portion with respect to the grinding wheel to perform a first traverse grinding of the common base circle portion, moving the grinding wheel from a position of the second cam to a second position beyond a boundary between the first and second cams in a traverse direction in a second direction opposite to the first direction, and-rotating the composite cam within the angular range of the common base circle portion with respect to the grinding wheel to perform a second traverse grinding of the common base circle portion.

6. The cam grinding method according to claim 5, wherein the first cam grinding step comprises rough grinding and fine grinding, the second cam grinding step comprises rough grinding, fine grinding, and spark-out, and the common base circle portion traverse grinding step is performed after the spark-out of the second cam grinding step.

7. The cam grinding method according to claim 6, wherein in the common base circle portion traverse grinding step, the grinding wheel is moved in the traverse direction in a range from the position of the second cam to a position of the first cam beyond the boundary between the first and second cams, and the cam grinding method further comprising:

a first cam spark-out step of, after the common base circle portion traverse grinding step, performing spark-out of the first cam with the grinding wheel.

8. The cam grinding method according to claim 5, wherein the traverse grinding in the common base circle portion traverse grinding step is oscillation grinding in which the grinding wheel is reciprocated in the axial direction between the first and second cams.

9. The cam grinding machine according to claim 1, wherein the common base circle portion traverse grinding unit performs an air grinding of the first cam between the first transverse grinding of the common base circle portion and the second transverse grinding of the common base circle portion.

* * * * *